US009039138B2

(12) United States Patent
Itogawa

(10) Patent No.: US 9,039,138 B2
(45) Date of Patent: May 26, 2015

(54) IMAGE FORMING APPARATUS, ASPIRATOR DEVICE, AND METHOD FOR ASPIRATE DUST IN AN IMAGE FORMING APPARATUS

(75) Inventor: Yoshihiro Itogawa, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/406,738

(22) Filed: Feb. 28, 2012

(65) Prior Publication Data

US 2012/0218347 A1 Aug. 30, 2012

(30) Foreign Application Priority Data

Feb. 28, 2011 (JP) ..... 2011-041744

(51) Int. Cl.
*B41J 2/165* (2006.01)
*B41J 29/17* (2006.01)

(52) U.S. Cl.
CPC ..... *B41J 2/16585* (2013.01); *B41J 29/17* (2013.01)

(58) Field of Classification Search
CPC ..... B41J 2/1714; B41J 2/08; B41J 2/20; B41J 2002/1742
USPC ..... 347/34
See application file for complete search history.

(56) References Cited

U.S. PATENT DOCUMENTS 6,945,628 B2 * 9/2005 Koitabashi et al. ..... 347/34
6,981,756 B2 * 1/2006 Fredrickson et al. ..... 347/34
7,044,581 B2 * 5/2006 Shimoyama ..... 347/34
7,044,582 B2 * 5/2006 Fredrickson et al. ..... 347/37
7,384,122 B2 * 6/2008 Shimizu ..... 347/34
7,387,367 B2 * 6/2008 Furukawa et al. ..... 347/55
7,604,332 B2 * 10/2009 Nagashima ..... 347/84
7,665,824 B2 * 2/2010 Riou et al. ..... 347/34
8,070,255 B2 * 12/2011 Shinkawa ..... 347/34
8,246,144 B2 * 8/2012 Katano et al. ..... 347/34
8,376,511 B2 * 2/2013 Shimoda et al. ..... 347/34
2006/0023021 A1 * 2/2006 Shimizu ..... 347/34
2007/0109348 A1 * 5/2007 Izawa et al. ..... 347/34

(Continued)

FOREIGN PATENT DOCUMENTS

JP S60-019637 A 1/1985
JP 2002-127516 A 5/2002

(Continued)

OTHER PUBLICATIONS

Japan Patent Office, Notification of Reasons for Rejection for Japanese Patent Application No. 2011-041744 (counterpart to above-captioned patent application), mailed Feb. 25, 2014.

*Primary Examiner* — Matthew Luu
*Assistant Examiner* — Patrick King
(74) *Attorney, Agent, or Firm* — Baker Botts L.L.P.

(57) ABSTRACT

An image forming apparatus is provided. The image forming apparatus includes a conveyer configured to convey a recording medium along a conveying path in a conveying direction, an image forming unit configured to form an image on the recording medium being conveyed, a supporting member arranged in a position to face the image forming unit and configured to support the recording medium, and an aspirator configured to aspirate dust through an aspiration inlet, which is formed in a downstream position along the conveying direction with respect to the image forming unit and in proximity to a downstream end of the supporting member.

19 Claims, 8 Drawing Sheets

(56) References Cited

U.S. PATENT DOCUMENTS

| | | | | |
|---|---|---|---|---|
| 2008/0143781 | A1* | 6/2008 | Inoue et al. | 347/34 |
| 2009/0002468 | A1* | 1/2009 | Ito | 347/92 |
| 2010/0128073 | A1* | 5/2010 | Togawa | 347/8 |
| 2012/0069085 | A1* | 3/2012 | Yamagishi et al. | 347/30 |
| 2012/0194606 | A1* | 8/2012 | Shinoda | 347/28 |
| 2012/0218347 | A1* | 8/2012 | Itogawa | 347/34 |

FOREIGN PATENT DOCUMENTS

| | | |
|---|---|---|
| JP | 2008-137196 A | 6/2008 |
| JP | 2010-214876 A | 9/2010 |

* cited by examiner

IMAGE FORMING APPARATUS, ASPIRATOR DEVICE, AND METHOD FOR ASPIRATE DUST IN AN IMAGE FORMING APPARATUS

CROSS REFERENCE TO RELATED APPLICATION

This application claims priority from Japanese Patent Application No. 2011-041744, filed on Feb. 28, 2011, the entire subject matter of which is incorporated herein by reference.

BACKGROUND

1. Technical Field

An aspect of the present invention relates to an image forming apparatus, such as a printer, a facsimile machine, and a multifunction peripheral device (MFP), etc., and more specifically, to a technique to collect dust produced in the image forming apparatus.

2. Related Art

An image forming apparatus (e.g., a printer, a facsimile machine, an MFP, etc.), in which an image is formed in ink on a sheet of paper being a recording medium whilst the sheet of paper is conveyed in a conveying path in a chassis, is known. Such an image forming apparatus may include, for example, an inkjet printer with a recording head, which ejects ink from an ejecting surface toward the recording sheet. The inkjet printer may have a platen for holding the recording sheet from below in a position opposite from the ejecting surface of the recording head across the conveying path. When the recording sheet being conveyed passes over the platen, the recording sheet may be chafed by the platen, and dust may be produced by the friction between the recording sheet and the platen. An amount of the dust produced by the friction may tend to increase as a speed to convey the recording sheet increases. The increased amount of dust may float inside the inkjet printer and may, for example, adhere to the ejecting surface of the recording head and disturb behaviors of the ejected ink. For another example, the dust may stay in the conveying path to spoil or ruin the recording sheet being conveyed. Further, the dust may accumulate in the chassis to cause an operation error in the inkjet printer. Therefore, it is preferable that the dust created by the friction between the platen and the recording sheet is collected immediately after the creation before it drifts in the chassis.

Meanwhile, an inkjet printer having a mechanism to collect mist of ink has been suggested. Such an inkjet printer may be configured to have a plurality of inlets in the platen in positions opposite from the recording head and an aspirator fan to aspirate the ink mist through the inlets. The aspirated ink may be collected to be stored in an ink container.

SUMMARY

The mechanism to collect the ink mist may be modified into a configuration to collect the dust created by the friction between the platen and the recording sheet. However, it is assumed that the modification causes several problems. Firstly, for example, when the air is aspirated at the position opposite from the recording head, the aspiration force may undesirably affect the recording head. More specifically, for example, meniscus formed in the ejecting surface of the recording head may collapse, and the ink may leak from nozzles in the recording head. In particular, when the aspiration force is generated whilst no recording sheet is at the position above the aspiration inlets, the meniscus may easily collapse. Secondly, the dust created by the friction caused between the recording sheet and the platen tend to flow toward a downstream with respect to a direction of conveying the recording sheet due to an air current, which can be created by the sheet conveyance. Therefore, the flown dust tends to accumulate at the downstream position with respect to the platen, which is at the opposite position from the recording head. Thus, even when the air is aspirated at the position opposite from the recording head, the dust may not be collected effectively or sufficiently.

In view of the difficulties, the present invention is advantageous in that an image forming apparatus, which can collect the dust created by the friction between the platen and the recording sheet effectively without affecting the image forming behaviors of the recording head, is provided.

According to an aspect of the present invention, an image forming apparatus is provided. The image forming apparatus includes a conveyer configured to convey a recording medium along a conveying path in a conveying direction, an image forming unit configured to form an image on the recording medium being conveyed, a supporting member arranged in a position to face the image forming unit and configured to support the recording medium, and an aspirator configured to aspirate dust through an aspiration inlet, which is formed in a downstream position along the conveying direction with respect to the image forming unit and in proximity to a downstream end of the supporting member.

According to another aspect of the present invention, an aspirator device for an image forming apparatus having a conveyer configured to convey a recording medium along a conveying path in a conveying direction, an image forming unit configured to form an image on the recording medium being conveyed, and a supporting member arranged in a position to face the image forming unit and configured to support the recording medium, is provided. The aspirator device includes an aspirator configured to aspirate dust through an aspiration inlet, which is formed in a downstream position along the conveying direction with respect to the image forming unit and in proximity to a downstream end of the supporting member, and an aspiration controller configured to control the aspirator to generate aspiration force in the aspiration inlet within a predetermined time period after a rear end of the recording medium passes by a downstream end of the supporting member along the conveying direction.

According to another aspect of the present invention, a method to aspirate dust in an image forming apparatus having an image forming unit and a supporting member is provided. The method includes steps of detecting a recording medium being conveyed in a conveying direction, and generating aspiration force in an aspiration position, which is in a downstream position along the conveying direction with respect to the image forming unit and in proximity to a downstream end of the supporting member, after a rear end of the recording medium being conveyed passes by a downstream end of the image forming unit.

BRIEF DESCRIPTION OF THE ACCOMPANYING DRAWINGS

DETAILED DESCRIPTION

Figure 1:
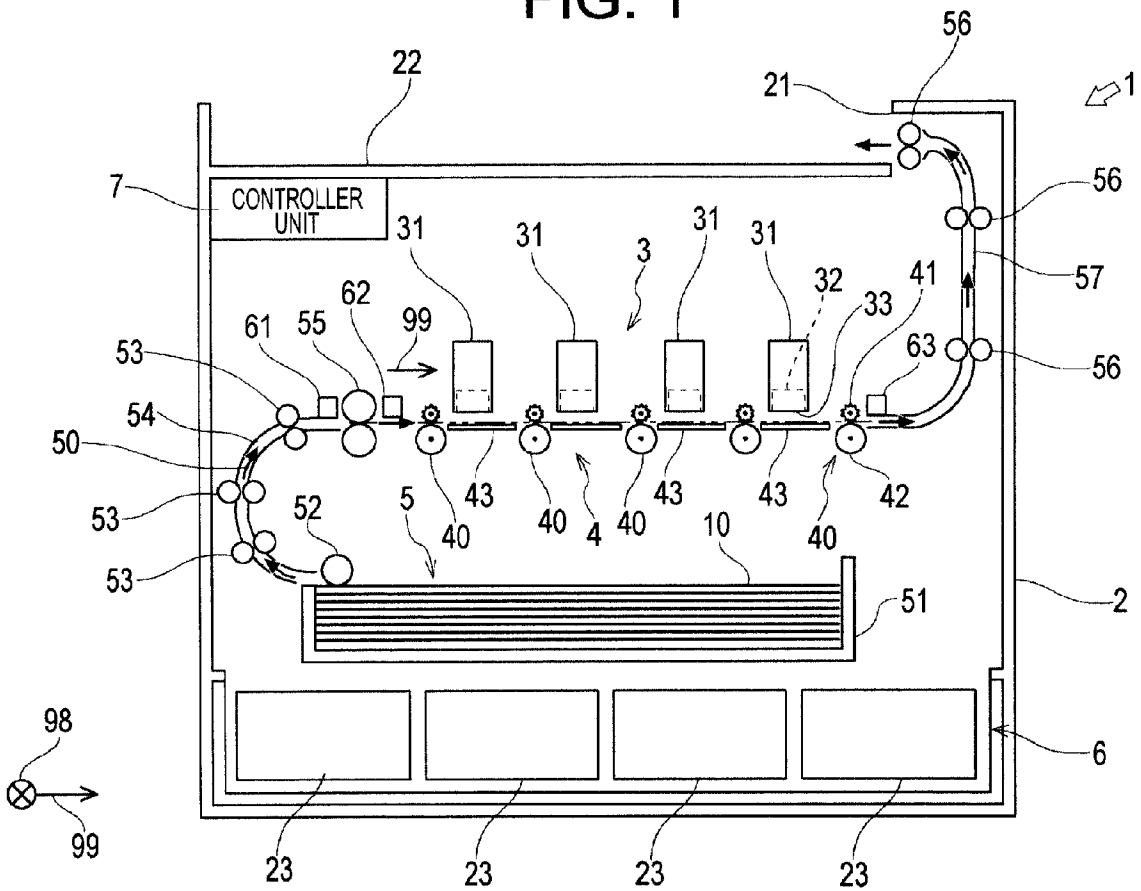
FIG. 1 is a diagram to illustrate a cross-sectional view of an inkjet printer according to an embodiment of the present invention.

Hereinafter, an embodiment of the present invention will be described with reference to the accompanying drawings. In the following description, one of a plurality of same or similar components may be referred to by an identical reference sign, and description of the one of the same or similar components may represent the remaining components.

An overall configuration of an inkjet printer 1 according to an embodiment of the present invention will be described with reference to FIG. 1. The inkjet printer 1 has a rectangular box-shaped chassis 2. The chassis 2 contains a head unit 3, a conveyer unit 4, a feeder unit 5, and a tank unit 6, which are arranged vertically from top to bottom in the order mentioned, therein. The conveyer unit 4 conveys sheets 10 of recording paper along a conveying direction 99 (e.g., from left to right) in a lower position with respect to the recording heads 31. The feeder unit 5 feeds the recording sheets 10 to the conveyer unit 4. The tank unit 6 includes ink tanks 23 to store inks. Further, inside the chassis 2, a controller unit 7 to control behaviors of each component in the inkjet printer 1 is provided in an interference-free position, in which the controller unit 7 is not interfered with by the other components. On a top plane of the chassis 2, a discharge unit 22, in which the recording sheets 10 with images formed thereon are discharged, is formed.

The head unit 3 includes four recording heads 31 to colored inks, which include black, cyan, magenta, and yellow inks. The recording heads 31 are arranged to align in line from upstream to downstream along a flow of the recording sheet 10 being conveyed in the conveying direction 99 in an ascending order of color brightness of the inks, i.e., black, cyan, magenta, and yellow, from left to right in FIG. 1.

The recording heads 31 are formed in a same structure, and each of the recording heads 31 is a line-typed inkjet head, which has a shape of a thin rectangular column elongated along a print-widthwise direction 98. The print-widthwise direction 98 in the present embodiment refers to a direction, which extends horizontally and orthogonally to the conveying direction 99. Each recording head 31 has a head 32 having a nozzle surface 33, in which a plurality of nozzles (not shown) are formed. The recording head 31 is arranged to have the nozzle surface 33 to vertically face the recording sheet 10, when the recording sheet 10 is conveyed in the conveying direction 99 by the conveyer unit 4. More specifically, the nozzle surface 33 faces downward to confront an upward surface of the recording sheet 10 being conveyed with a predetermined amount of clearance maintained in between the nozzle surface 33 and the recording sheet 10. The head 32 is provided with a plurality of actuators (not shown), which apply ejecting force to the ink to selectively eject the ink through the nozzles.

The tank unit 6 includes four ink tanks 23, which are removably installed in the chassis 2. The ink tanks 23 stores the black, cyan, magenta, and yellow inks therein. The stored inks are supplied to the recording heads 31 via tubes (not shown).

The feeder unit 5 includes a sheet-feed tray 51, which is removably installed in the chassis 2, and a pickup roller 52. The sheet-feed tray 51 is formed to have a shape of a top-open flat box, and a stack of recording sheets 10 can be stored therein. The pickup roller 52 is arranged to be in contact with a topmost recording sheet 10 amongst the stack of recording sheets 10 stored in the sheet-feed tray 51. When the pickup roller 52 rotates, the topmost recording sheet 10 being in contact with the pickup roller 52 is forwarded to be fed in a conveying path 50.

The conveying path 50 is formed in the chassis 2 to direct the recording sheet 10 from the sheet-feed tray 51 to the discharge unit 22 along thick arrows indicated in FIG. 1. The conveying path 50 is formed approximately in a shape of a horizontally reversed "S" in a side view (see FIG. 1), and the conveyer unit 4 and a plurality of conveyer guides 57 serve as parts of the conveying path 50. The recording sheet 10 fed from the sheet-feed tray 51 in the conveying path 50 by the pickup roller 52 is forwarded by a plurality of pairs of feed rollers 53 to the conveyer unit 4 along a conveyer guide 54. In an upstream position with respect to the conveyer unit 4 along the conveying direction 99, a pair of register rollers 55 is provided. The register roller pair 55 corrects an orientation of the recording sheet 10 being conveyed in the conveying path 50 with respect to the conveying direction 99 before the recording sheet 10 enters the conveyer unit 4. The conveyer unit 4 conveys the recording sheet 10 to a printable position, which is a lower position with respect to the recording heads 31, and carries the recording sheet 10 in a predetermined conveying speed along the conveying direction 99. As the recording sheet 10 with the image formed thereon exits the conveyer unit 4, at a downstream position with respect to the conveyer unit 4, the recording sheet 10 is directed upward by a plurality of pairs of conveyer rollers 56 along the conveyer guide 57 and discharged via a sheet outlet 21 formed in an upper position in the chassis 2. Thus, the recording sheet 10 is released in the discharge unit 22.

The conveyer unit 4 includes a plurality of pairs of conveyer rollers 40, which are arranged along the conveying direction 99 of the recording sheet 10, and a plurality of platens 43, which are arranged in intermediate positions between adjoining conveyer roller pairs 40 in line horizontally along the conveying direction 99. Each of the platens 43 is arranged in a lower position with respect to one of the recording heads 31 to face the nozzle surface 33 of the recording head 31. The platen 43 supports the recording sheet 10 from a lower side. One of the pairs of conveyer rollers 40 is arranged in a most upstream position with respect to a set of the recording heads 31, and another one of the pairs of conveyer rollers 40 is arranged in a most downstream position with respect to the set of the recording heads 31. Further, in each intermediate position between adjoining recording heads 31, a pair of conveyer rollers 40 is arranged. Each of the conveyer roller pairs 40 includes an upper roller 41 and a lower roller 42, which are arranged in an upper position and a lower position with respect to the recording sheet 10 in the conveying path 50 in the conveyer unit 4. In particular, the lower roller 42 is disposed in a position, in which a circumference thereof can contact the lower surface of the recording sheet 10. The upper roller 41 includes a shaft and a plurality of disks, which have gear teeth on circumferences thereof, aligned in line along the print-widthwise direction 98. The upper roller 41 is disposed in an opposite position from the lower roller 42 to face the circumference of the lower roller 42 across the recording sheet 10 in the conveying path 50. The upper roller 41 is urged toward the lower roller 42 by an urging member (not shown), and the circumferences with the teeth of the upper roller 41 are pressed against the circumference of the lower roller 42. When a conveyer motor 68 (see FIG. 2) rotates the plurality of lower rollers 42 in the conveyer unit 4 synchronously, the recording sheet 10 in between the upper rollers 41 and the lower roller 42 are conveyed in the conveying direction 99 toward the downstream.

Figure 2:
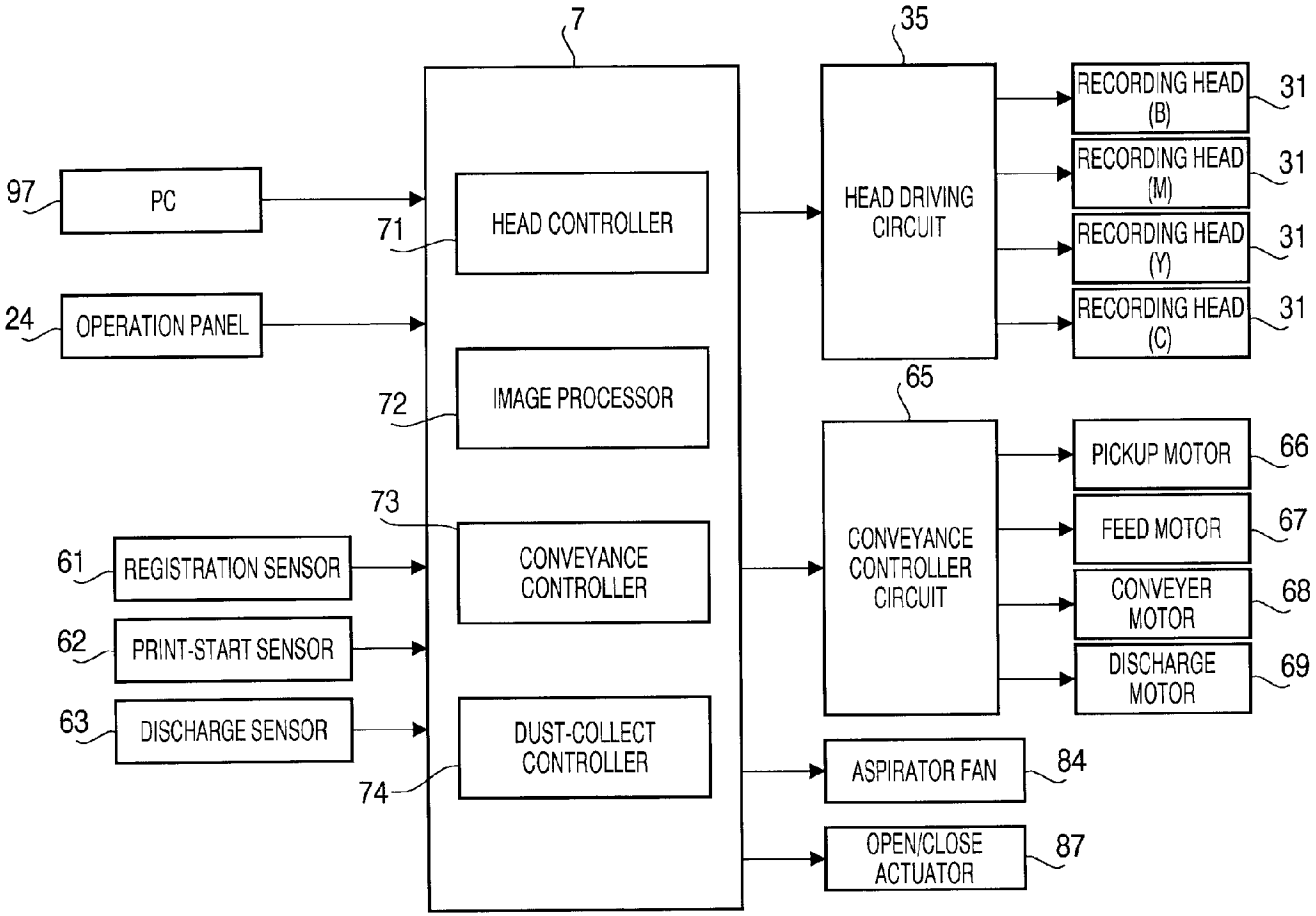
FIG. 2 is a block diagram to illustrate an electrical configuration of the inkjet printer according to the embodiment of the present invention.

Next, a controlling system of the inkjet printer 1 will be described with reference to FIG. 2. The controller unit 7 in the inkjet printer 1 includes at least one computer, which includes a central processing unit (CPU), a rewritable main memory device, a subsidiary memory device, interfaces, and inner buses, which are not shown. The main memory device stores rewritable programs which are to be executed by the CPU and data to be used along with the programs, and the subsidiary memory device temporarily stores data whilst the programs are executed by the CPU. The interfaces connect the CPU of the inkjet printer 1 with other external devices (e.g., a PC 97). The internal buses connect the above-described components in the computer with one another. The programs to be executed by the CPU may be stored in a memory medium, which may be, for example, a flexible disk, a CD-ROM, and a memory card, and may be installed in the CPU. Thus, the components in the controller unit 7 shown in FIG. 2 may be achieved by executing the programs.

The controller unit 7 is connected with an operation panel 24, which is an input/output (I/O) device, via one of the interfaces. When a user enters information concerning operations of the inkjet printer 1 through the operation panel 24, signals representing the information are inputted in the controller unit 7, and the controller unit 7 manipulates the components in the inkjet printer 1 based on the inputted signals. The operation panel 24 includes a display (not shown), which displays character strings and signs representing information to be provided to the user concerning the operations. Moreover, the controller unit 7 may be connected with an external computer (e.g., a PC) 97 via one of the interfaces to exchange data. Thus, the controller unit 7 in the inkjet printer 1 controls behaviors of the inkjet printer 1 based on image data and the information provided by the external computer 97 and through the operation panel 24.

The controller unit 7 is connected with various sensors including a registration sensor 61, a print-start sensor 62, and a discharge sensor 63. Signals representing sensed results detected by the sensors 61, 62, 63 are received by the controller unit 7. The registration sensor 61 is arranged along the conveying path 50 in an upstream position with respect to the register roller pair 55 to detect presence of the recording sheet 10 approaching the register roller pair 55. When the recording sheet 10 is detected, the registration sensor 61 generates a signal representing the detected result, and the controller unit 7 activates the head unit 3 to form the image. The print-start sensor 62 is arranged along the conveying path 50 in a downstream position with respect to the register roller pair 55 and an upstream position with respect to the head unit 3. The print-start sensor 62 detects a front end of the recording sheet 10 being conveyed in the conveying path 50. In this regard, the front end of the recording sheet 10 refers to an edge, which enters firstly in the conveying path 50 and is closest to a destination (i.e., the discharge unit 22) of the sheet-conveyance. On the other hand, a rear end of the recording sheet 10 refers to an edge opposite from the front edge furthest from the destination. Based on the timing, on which the front end of the recording sheet 10 is detected by the print-start sensor 62, the recording heads 31 in the head unit 3 start ejecting the inks. The discharge sensor 63 is arranged along the conveying path 50 in a downstream position with respect to the head unit 3. The discharge sensor 63 detects the rear end of the recording sheet 10 being conveyed in the conveying path 50.

The controller unit 7 has a plurality of functions to serve as, for example, a head controller 71, an image processor 72, a conveyance controller 73, and a dust-collect controller 74. The image processor 72 generates output-image data (i.e., raster image data), which represents sizes of dots to be formed in unit areas virtually defined on the recording sheet 10, based on print data provided from the external computer 97 and printer driver software.

The head controller 71 generates signals to be provided to head driving circuit 35 based on the output-image data generated in the image processor 72. The head driving circuit 35 controls behaviors of the recording heads 31 to selectively eject inks onto the recording sheet 10 based on predetermined timings according to the signals generated in the head controller 71.

The conveyance controller 73 controls activation of a pickup motor 66, a feed motor 67, a conveyer motor 68, and a discharge motor 69, which drive the pickup roller 52, the feed roller pairs 53, the conveyer roller pairs 40, and the discharge roller pairs 56 respectively, in order to convey the recording sheet 10 along the conveying path 50 based on the output-image data generated in the image processor 72. Therefore, the conveyance controller 73 outputs controlling signals based on the output-image data to a conveyance controller circuit 65, which generates signals to drive the above-mentioned motors 66, 67, 68, 69 based on the controlling signals provided from the conveyance controller 73. In the present embodiment, the pickup roller 52, the feed roller pairs 53, the conveyer roller pairs 40, and the discharge roller pairs 56 are driven by the corresponding motors, which are the pickup motor 66, the feed motor 67, the conveyer motor 68, and the discharge motor 69 respectively. However, the pickup roller 52, the feed roller pairs 53, the conveyer roller pairs 40, and the discharge roller pairs 56 may be entirely driven by a single motor. In this regard, driving force from the single motor may be distributed to the pickup roller 52, the feed roller pairs 53, the conveyer roller pairs 40, and the discharge roller pairs 56 via known driving systems including gears and shafts.

The dust-collect controller 74 activates an aspirator fan 84 and an open/close actuator 87 to control a dust-collecting device 80. The dust-collect controller 74 and the dust-collecting device 80 will be described later in detail.

An image forming operation in the inkjet printer 1 will be described hereinbelow. When the controller unit 7 receives the print data from an external device such as the external computer 97 and a memory card (not shown), the controller unit 7 creates the image-output data and starts feeding the recording sheet 10 from the sheet-feed tray 51 based on the image-output data. More specifically, the pickup motor 66 is activated to rotate the pickup roller 52, and the recording sheet 10 is fed from the sheet-feed tray 51 into the conveying path 50. Further, as the feed motor 67, the conveyer motor 68, and the discharge motor 69 are activated, the feed roller pairs 53, the conveyer roller pairs 40, and the discharge roller pairs 56 are rotated, and the recording sheet 10 is forwarded along the conveying path 50. When the front end of the recording sheet 10 being conveyed is detected by the registration sensor 61, the controller unit 7 outputs the image-output data to the head driving circuit 35 according to the timing based on the detection. Thereafter, the recording heads 31 eject the inks toward the recording sheet 10 being conveyed by the conveyer unit 4 based on the timing, on which the front end of the recording sheet 10 is detected by the print-start sensor 62. Accordingly, the image is formed in colors on the upper surface of the recording sheet 10. The recording sheet 10 with the formed image is conveyed toward the further downstream of the conveying path 50 with respect to the conveyer unit 4. Thereafter, the recording sheet 10 is conveyed upward by the discharge roller pairs 56 along the conveyer guide 57 and discharged out of the chassis 2 via the sheet outlet 21 to be released in the discharge unit 22.

Figure 3:
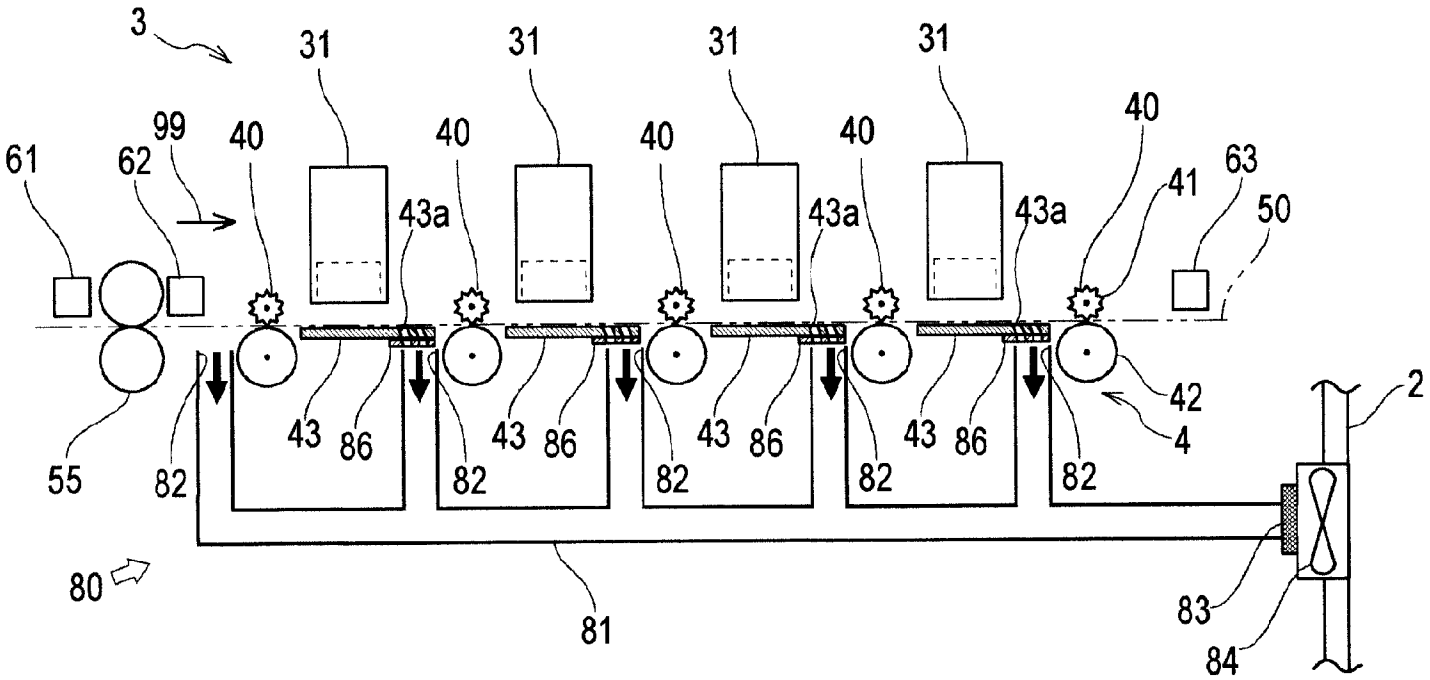
FIG. 3 is a diagram to illustrate a dust collecting device in the inkjet printer according to the embodiment of the present invention.

Next, the dust-collecting device 80 and the dust-collect controller 74 will be described with reference to FIGS. 3-7. The dust-collecting device 80 includes a mechanism to collect the dust, which may be created by the friction between the recording sheet 10 being conveyed in the conveying path 50 and the platen 43. As shown in FIG. 3, the dust-collecting device 80 includes a duct 81, an aspirator fan 84 to eject air from the duct 81, and a filter 83 to catch the dust in the air being ejected from the duct 81. The duct 81 has aspiration inlets 82, which are formed at downstream positions with respect to the platens 43 along the conveying direction 99 and at an intermediate position between the register roller pair 55 and one of the conveyer roller pairs 40 at the most upstream position. In particular, the aspiration inlets 82 formed at the downstream positions with respect to the platens 43 can draw the dust, which is created by the friction between the recording sheet 10 and the platens 43 being conveyed, in the duct 81 along with the air. Meanwhile, the aspiration inlet 82 formed at the intermediate position between the register roller pair 55 and the most upstream conveyer roller pair 40 can draw the dust, which is created by the friction amongst the recording sheet 10, the pickup roller 52, the conveyer guide 54, and the register roller pair 55, in the duct 81. Each of the aspiration inlets 82 may be a single opening or may be a group of smaller openings.

Figure 4:
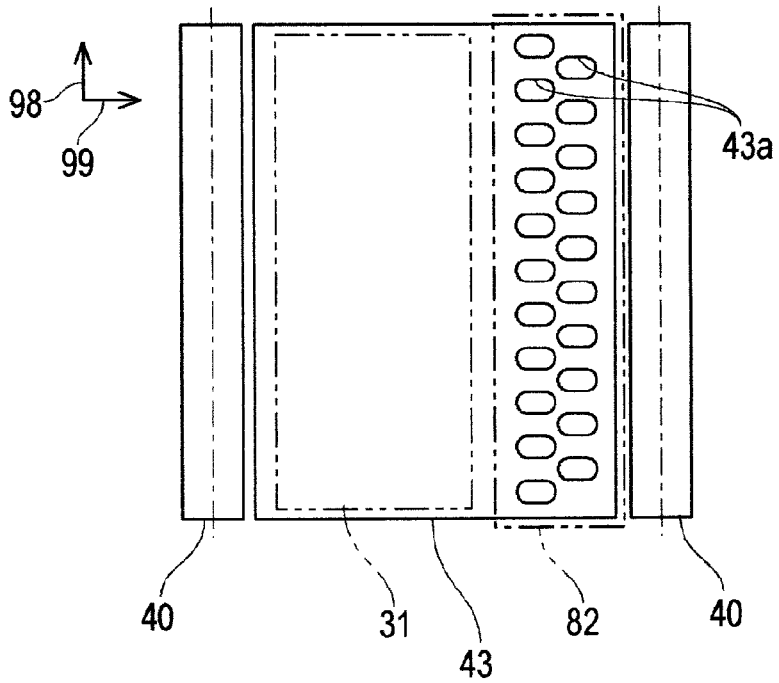
FIG. 4 is a plane view of a platen and its surrounding components in the inkjet printer according to the embodiment of the present invention.
Figure 5:
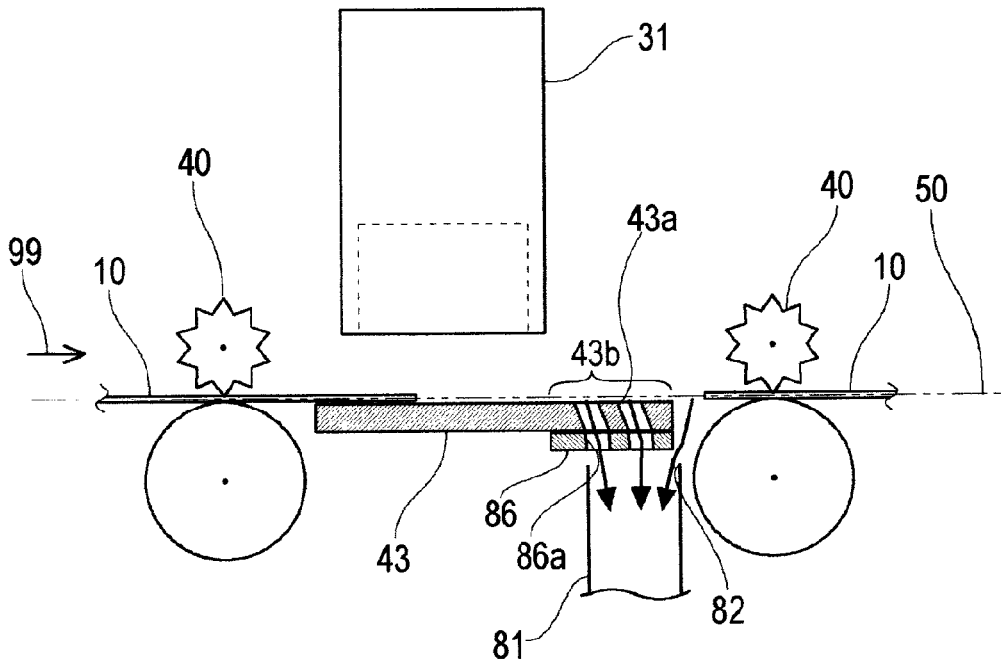
FIG. 5 is an enlarged partial view of the dust collecting device in the inkjet printer according to the embodiment of the present invention.

As shown in FIG. 4, each of the former aspiration inlets 82 at the downstream positions with respect to the platens 43 is formed in a lower position with respect to the platen 43, in an area proximate to a downstream end of the platen 43, and in a downstream position with respect to an image-formable area on the platen 43 along the conveying direction 99. In this regard, the image-formable area on the platen 43 refers to an area, in which the ink ejected from the recording head 31 toward the recording sheet 10 on the platen 43 should fall, and an area which is straight below the nozzle surface 33 of the recording head 31. More specifically, whilst the platen 43 has an extended part 43*b*, which extends along the conveying direction 99 beyond a downstream end of the recording head 31, i.e., on a downstream side with respect to the recording head 31, and whilst a downstream end of the extended part 43*b* is in a position proximate to the conveyer roller pairs 40, the aspiration inlet 82 of the duct 81 is formed at a position below the extended part 43*b*. In other words, the aspiration inlet 82 vertically coincides with the extended part 43*b* of the platen 43. In the extended part 43*b* of the platen 43, a plurality of inlet openings 43*a* are formed. Meanwhile, the dust in the conveyer unit 4 tends to accumulate at a downstream end area of the platen 43. Therefore, with the platen 43 having the extended part 43*b* extending toward the downstream side along the conveying direction 99, the dust-accumulative downstream end part 43*b* of the platen 43 is prevented from being vertically coincident with the recording head 31. At the same time, the aspiration inlet 82 and the inlet openings 43*a* formed in the dust-accumulative area can absorb the accumulative dust effectively. Further, whilst the aspiration inlet 82 and the inlet openings 43*a* are formed at the positions outside the image-formable area, that is, in an area not coincident with the recording head 31, the nozzle surface 33 of the recording head and the ink ejected from the nozzle surface 33 can be prevented from being affected by aspiration force generated in the aspiration inlet 82. More specifically, the nozzle surface 33 of the recording head 31 may be prevented from being affected by negative pressure, which is caused by the air current being drawn in the duct 81. Further, whilst the air in the conveyer unit 4 may be affected by the aspiration force, and the affected air flow may hinder the ink droplets from falling on correct positions, with the aspiration inlet 82 being formed at the position outside the image-formable area, the ink droplets may not be affected by the aspiration force, but may be prevented from being spattered on wrong positions. Moreover, if the inlet 83 is formed in a position coincident with the image-formable area of the platen 43, the recording sheet 10 on the platen 43 may be absorbed to be closely fitted to edges of the inlet openings 43*a* of the platen 43, and the recording sheet 10 may unevenly undulate. In this regard, with the aspiration inlet 82 and the inlet openings 43*a* being formed at the positions outside the image-formable area, the recording sheet 10 may be prevented from being fitted to the image-formable area on the platen 43 and from undulation. Thus, without largely affecting image-forming behavior of the inkjet printer 1, the dust can be effectively collected.

The platen 43 is provided with an openable/closable shutter 86, which can uncover and cover the inlet openings 43*a*. The shutter 86 is a piece of flat plate, in which communication openings 86*a* are formed in positions which correspond to the inlet openings 43*a* in the platen 43. The shutter 86 is movable to reciprocate between an opening position (see FIG. 5) and a closing position (see FIG. 6) according to opening and closing behaviors of the open/close actuator 87. In the opening position, the inlet openings 43*a* in the platen 43 and the communication openings 86*a* in the shutter 86 vertically coincide with each other. Thus, the inlet openings 43*a* and the aspiration inlet 82 are in fluid communication with each other via the communication openings 86*a*. In other words, the inlet openings 43*a* on the platen 43 serve as an inlet for the duct 81. In the closing position, on the other hand, the inlet openings 43*a* and the communication openings 86*a* are in vertically displaced positions from each other. The open/close actuator 87 may include, for example, an electric motor and transmissions.

The dust-collect controller 74 in the controller unit 7 controls the dust-collecting device 80, which manipulates the behaviors of the aspiration fan 84 and the open/close actuator 87, based on predetermined timings. The dust-collect controller 74 activates the aspirator fan 84 to rotate when the inkjet printer 1 is powered on and stops the aspirator fan 84 when the inkjet printer 1 is powered off. Therefore, when the inkjet printer 1 is powered, negative pressure is created in the duct 81 at all times, and the aspiration force is created at the aspiration inlets 82. Alternatively, the aspirator fan 84 may be activated in a limited period between receipt of a print job in the inkjet printer 1 and completion of the print job. Thus, the aspiration force may be created in the limited period, which is necessary for the print job to be processed.

Figure 6:
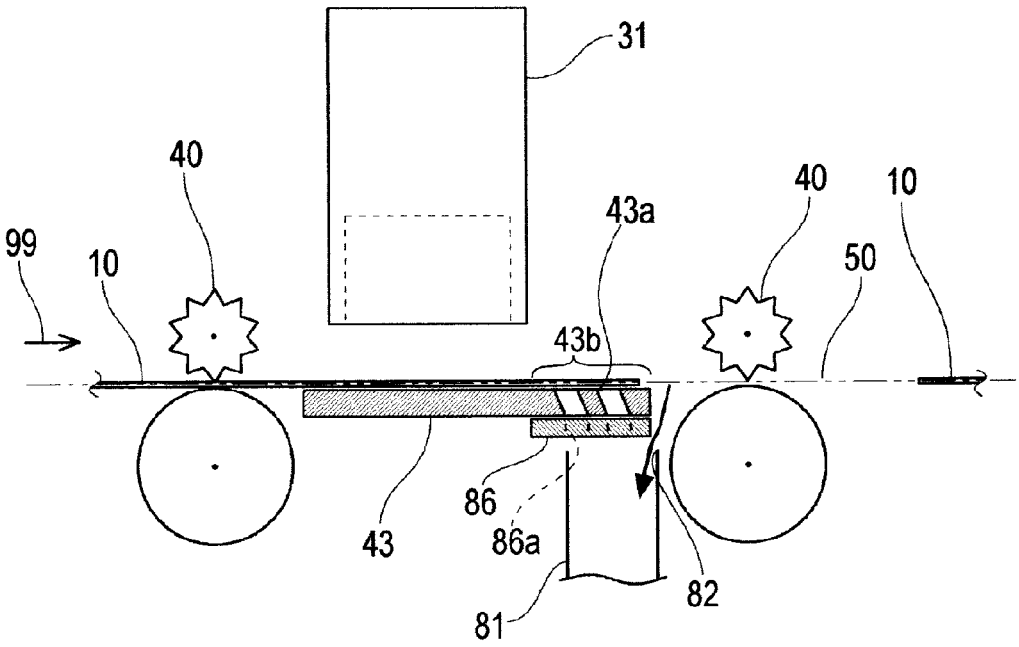
FIG. 6 is an enlarged partial view of the dust collecting device in the inkjet printer according to the embodiment of the present invention with aspiration inlets being closed.

The shutter 86 is initially at the closing position (see FIG. 6). When the aspirator fan 84 is driven, and negative pressure is created in the duct 81, with the shutter 86 being in the closing position, dust contained in the air in the vicinity of the downstream end of the platen 43 and the conveyer roller pair 40 is drawn in the duct 81 through clearance between the downstream end of the platen 43 and the aspiration inlet 82. The dust drawn in the duct 81 is caught by the filter 83.

As the printing operation proceeds, and the sheet 10 is conveyed along the conveying direction 99, the rear end of the recording sheet 10 passes over the inlet openings 43*a* in the platen 43 and the downstream end of the platen 43. In this regard, the dust-collect controller 74 activates the open/close actuator 87 to produce the aspiration force at the inlet openings 43*a* formed in the platen 43 for a predetermined length of period from the passing of the recording sheet 10. In other words, the dust-collect controller 74 in the controller unit 7 controls the open/close actuator 87 to move the shutter 86 to the opening position when the rear end of the recording sheet 10 passes by one of the inlet opening 43*a* and the downstream end of the platen 43 along the conveying direction 99. Further, the dust-collect controller 74 controls the open/close actuator 87 to move the shutter 86 to the closing position after a predetermined aspiration period from the opening of the shutter 86 elapses. The rear end of the recording sheet 10 passing by the inlet openings 43*a* in the platen 43 or the downstream ends of the platens 43 may be determined based on the timing, on which the front end of the recording sheet 10 is detected by the print-start sensor 62, and in consideration of a speed to convey the recording sheet 10 and length of a period to convey the recording sheet 10. For example, when the sheet-conveyance requires, from detection of the front end of the recording sheet 10 by the print-start sensor 62 until the rear end of the recording sheet 10 passing by one of the inlet openings 43*a* and the downstream end of the platen 43, a first length of period, the dust-collect controller 74 manipulates the shutter 86 to move to the opening position after the first length of period elapses from the detection of the front end of the recording sheet 10 by the print-start sensor 62. After a predetermined length of aspiration period elapsed from the opening of the shutter 86, the dust-collect controller 74 manipulates the shutter 86 to move back to the closing position. The positions of the front end and/or the rear end of the recording sheet 10 on the platen 43 may be determined based on an amount of rotation of the conveyer roller pairs 40 after the detection of the front end of the recording sheet 10 by the print-start sensor 62. Further, the length of the aspiration period may be determined in consideration of, for example, aspiration ability of the aspirator fan 84 and incidence of the dust to be created in the recording sheets 10, in order to substantially collect the dust. In this regard, the length of the aspiration period should be within a period between the time, when a rear end of a preceding sheet 10 passes by one of the inlet opening 43*a* and the downstream end of the platen 43, and the time when a front end of a succeeding new sheet 10 reaches the same inlet openings 43*a*. In other words, dust-collect controller 74 may shut off the aspiration force before the new recording sheet 10 conveyed in the conveying path 50 reaches the downstream end of the recording head 31.

Figure 7:
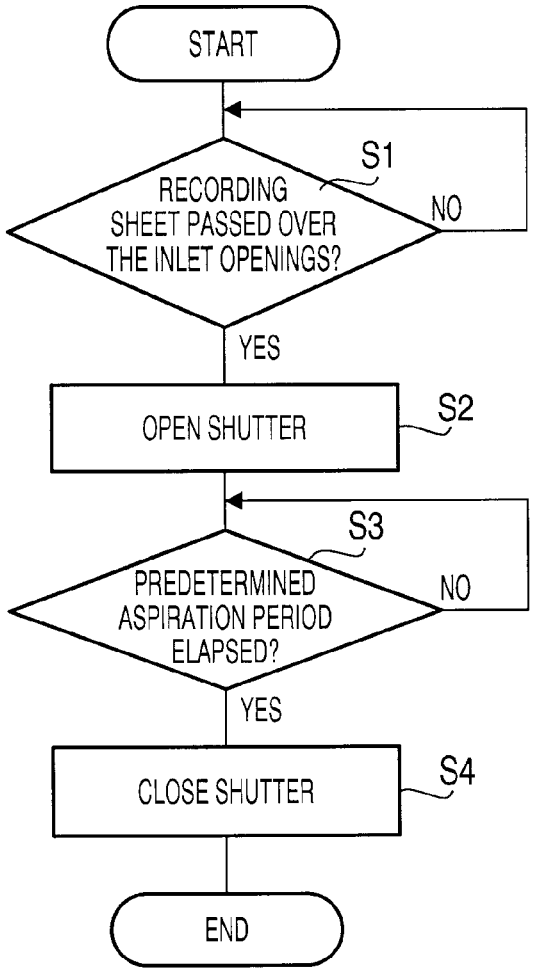
FIG. 7 is a flowchart to illustrate a controlling flow of the dust-collect controller in the inkjet printer according to the embodiment of the present invention.

The flow to control the open/close actuator 87 to move the shutter 86 is shown in FIG. 7. In the following description of the controlling flow, the expression "one of the inlet openings 43*a* and the downstream end of the platen 43" may be replaced with "at least the inlet openings 43*a*." The controlling flow is activated when the inkjet printer 1 starts the printing operation. In S1, it is examined whether the rear end of the recording sheet 10 passed over at least the inlet openings 43*a*. If the rear end of the recording sheet 10 has not passed over the inlet openings 43*a* (S1: NO), the flow repeats S1. If the rear end of the sheet passed over the inlet openings 43*a* (S1: YES), in S2, the dust-collect controller 74 manipulates the open/close actuator 87 to move the shutter 86 to the opening position. Thereafter, in S3, it is examined whether the predetermined aspiration period from the opening of the shutter 86 elapsed. If the aspiration period has not elapsed (S3: NO), the flow repeats S3. If the aspiration period elapsed (S3: YES), in S4, the dust-collect controller 74 manipulates the open/close actuator 87 to move the shutter 86 to the closing position. The flow ends thereafter.

When the shutter 86 is in the opening position (S2) (see FIG. 5), negative pressure is created in the duct 81 by the aspirator fan 84. Therefore, the dust contained in the air above the platen 43 is drawn in the duct 81 through the inlet openings 43*a* and the aspiration inlet 82. Further, the dust contained in the air in the vicinity of the downstream end of the platen 43 and the conveyer roller pair 40 is drawn in the duct 81 through the clearance between the downstream end of the platen 43 and the aspiration inlet 82. The dust drawn in the duct 81 is caught by the filter 83.

Thus, the aspiration force is produced at the inlet openings 43*a* after the rear end of the recording sheet 10 passes by at least the inlet openings 43*a* formed in the platen 43. Therefore, the recording sheet 10 can be prevented from being absorbed to be fitted the platen 43. In other words, the dust accumulating and floating in the downstream area of the platen 43 can be effectively collected whilst conveyance of the recording sheet 10 is prevented from being interfered with by the aspiration force. In particular, in a line-typed printer, such as the inkjet printer 1 according to the present embodiment with the recording heads 31, the recording sheet 10 may be conveyed in a faster speed compared to a serial-head printer, and dust may tend to be created more easily by the friction between the platens 43 and the recording sheet 10 when the recording sheet 10 is conveyed in the faster speed. In other words, a larger amount of dust may be created in the line-typed inkjet printer 1. In this regard, according to the present embodiment, the created dust is collected immediately after the creation by the dust-collecting device 80. Therefore, the created dust is prevented from being flown in the chassis 2 to adhere to the nozzle surface 33, and ejection of the inks from the recording heads 31 may be prevented from being interfered with by the dust. Further, the conveying path 50 and the recording sheet 10 in the conveying path 50 may be prevented from being spoiled by the drifting dust. Furthermore, the dust, which may cause an operation error in the inkjet printer 1, may be prevented from being accumulated in the chassis 2. Moreover, with the aspiration force being created at the inlet openings 43*a* immediately after the rear end of the recording sheet 10 passes by inlet openings 43*a* and the downstream end of the platen 43, the dust can be collected even more effectively. That is, the air current created by the recording sheet 10 passing over the platen 43 tends to scatter the dust upward to float in upstream areas (i.e., leftward areas with respect to the recording heads 31 in FIG. 1) along the conveying direction 99. However, with aspiration force, which is created immediately after the rear end of the recording sheet 10 passes by at least the inlet openings 43*a*, the dust can be collected before it drifts in the chassis 2.

In the embodiment described above, the dust-collect controller 74 manipulates the shutter 86 to move from the initial closing position to the opening position. However, the shutter 86 may be set in the opening position initially, and the dust-collect controller 74 may manipulate the shutter 86 to move the shutter 86 in the initial opening position to the closing position based on a predetermined timing. In this configuration, with the shutter 86 being in the opening position, the aspiration force may be created at the inlet openings 43*a*. During a limited period, when the recording sheet 10 is above the inlet openings 43*a*, the dust-collect controller 74 may manipulate the open/close actuate 87 to stop producing the aspiration force. In other words, the dust-collect controller 74 may manipulate the shutter 86 to move to the closing position immediately before the front end of the recording sheet 10 reaches the inlet openings 43*a* in the platen 43, and once the rear end of the recording sheet 10 passes by at least the inlet openings 43*a*, the dust-collect controller 74 may manipulate the shutter 86 to move back to the initial opening position to shut off the aspiration force. Thus, the recording sheet 10 may be similarly prevented from being fitted to the platen 43.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above-described embodiment, four aspiration inlets 82 are provided in the downstream positions for the four platens 43 respectively; however, the aspiration inlet 82 of the duct 81 may not necessarily be provided in each downstream position of each platen 43 as long as at least one aspiration inlet 82 is provided in a downstream position of at least one of the platens 43. In this regard, when solely one aspiration inlet 82 is provided to the duct 81, it is preferable that the sole aspiration inlet 82 is arranged in a downstream position with respect to one of the platens 43, which is in a most downstream position amongst the set of platens 43 arranged along the conveying direction 99. With the aspiration inlet 82 in the most downstream position, the dust created by the friction between the recording sheet 10 and the platens 43 may be collected at the most accumulative area.

Figure 8:
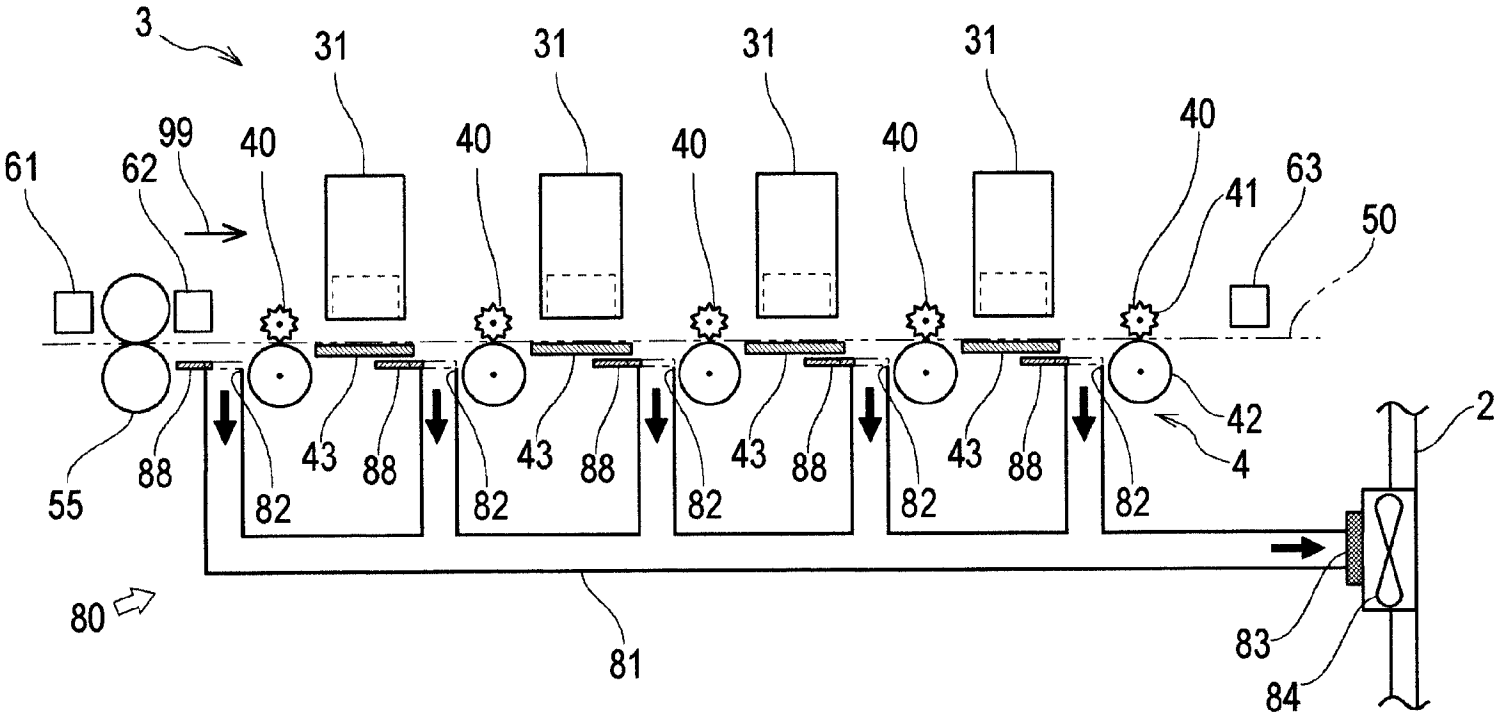
FIG. 8 is a diagram to illustrate a side view of a modified example of the dust collecting device in the inkjet printer according to the embodiment of the present invention.

For another example, the platen 43 may not necessarily be provided with the extended part 43*b*, which extends along the conveying direction 99 on the downstream side with respect to the recording head 31, but the platen 43 may be formed in an equivalent dimension to the recording head 31 along the conveying direction 99. When the dimensions of the platen 43 and the recording head 31 along the conveying direction 99 are equivalent, the aspiration inlet 82 of the duct 81 may be arranged in a position between the downstream end of the platen 43 and the conveyer roller pair 40 (see FIG. 8). In this position, the aspiration inlet 82 is still outside the image-formable area of the platen 43 and can collect the dust without affecting the image-forming behaviors the inkjet printer 1. In this configuration, it is preferable that a shutter 88 to open and close the aspiration inlet 82 is provided to the duct 81, and the aspiration inlet 82 is exposed only in a limited aspiration period after the rear end of the recording sheet 10 passes by the downstream end of the recording head 31. According to this configuration, the platens 43 may be formed in a smaller dimension along the conveying direction 99; therefore, a dimension of the inkjet printer 1 along the conveying direction may be reduced, and the entire inkjet printer 1 may be downsized.

Figure 9:
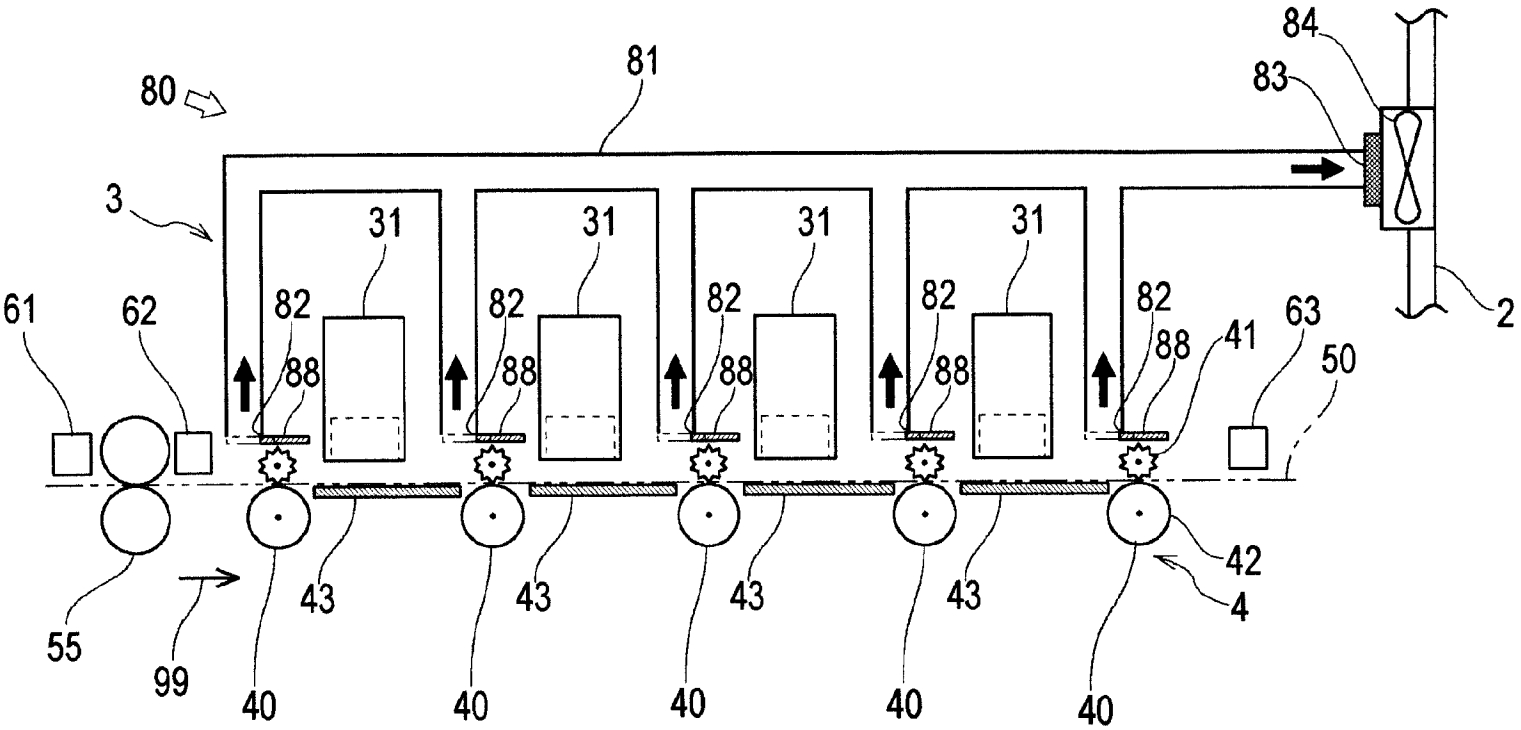
FIG. 9 is a diagram to illustrate a side view of another modified example of a dust collecting device in the inkjet printer according to the embodiment of the present invention.

For another example, the duct 81 and the aspiration inlet 82 may not necessarily be arranged in the lower position with respect to the platen 43 but may be arranged in an upper position with respect to the platen 43 (see FIG. 9). As shown in FIG. 9, the inlets may be formed in upward and downstream positions with respect to the platens 43 along the conveying direction 99 and at an upward intermediate position between the register roller pair 55 and the one of the conveyer roller pairs 40 at the most upstream position. In this configuration, it is again preferable that a shutter 88 to open and close the aspiration inlet 82 is provided to the duct 81, and the aspiration inlet 82 is exposed only in a limited aspiration period after the rear end of the recording sheet 10 passes by the downstream end of the recording head 31.

The present invention can be applied not only to printers but also to facsimile machines and copying machines. The recording head (image forming unit) may form an image by line type inkjet head(s) or a serial type inkjet head. Further, the recording head 31 may form an image by electrophotographic laser head(s).

What is claimed is:

1. An image forming apparatus, comprising:

a conveyer configured to convey a recording medium along a conveying path in a conveying direction;

an image forming unit configured to form an image on the recording medium being conveyed;

a supporting member arranged in a position to face the image forming unit and configured to support the recording medium;

a sensor configured to detect the recording medium conveyed by the conveyer;

an aspirator configured to aspirate dust through an aspiration inlet, which is formed in a downstream position along the conveying direction with respect to the image forming unit and in proximity to a downstream end of the supporting member; and an aspiration controller configured to:

control the aspirator to never generate an aspiration force at the aspiration inlet while the recording medium faces the aspiration inlet and until a rear end of the recording medium passes by the aspiration inlet along the conveying direction, based on a detected result by the sensor; and control the aspirator to start generating the aspiration force at the aspiration inlet within a predetermined time period after the rear end of the recording medium passes by the aspiration inlet along the conveying direction.

2. The image forming apparatus according to claim 1, wherein the aspiration inlet is formed in a downstream position along the conveying direction with respect to the supporting member.

3. The image forming apparatus according to claim 2, wherein the aspiration controller is configured to control the aspirator to generate the aspiration force at the aspiration inlet within a predetermined time period after the rear end of the recording medium passes by the downstream end of the supporting member along the conveying direction.

4. The image forming apparatus according to claim 3, wherein the aspirator includes an openable member, which is configured to open and close the aspiration inlet;

wherein the aspiration controller is configured to control the aspirator so that an opening movement of the openable member causes the aspiration force to be produced at the aspiration inlet.

5. The image forming apparatus according to claim 1, wherein the supporting member includes an extended part, which extends beyond a downstream end of the image forming unit along the conveying direction; and wherein the aspiration inlet is formed in the extended part of the supporting member.

6. The image forming apparatus according to claim 1, wherein the aspiration controller is configured to control the aspirator to shut off the aspiration force within a predetermined period after starting generation of the aspiration force in the aspiration inlet.

7. The image forming apparatus according to claim 6, wherein the aspiration controller is configured to control the aspirator to shut off the aspiration force before a new recording medium conveyed in the conveying path reaches a downstream end of the image forming unit.

8. The image forming apparatus according to claim 1, wherein the aspirator starts generating aspiration force at the aspiration inlet within a predetermined time period after a rear end of the recording medium passes by the aspiration inlet.

9. The image forming apparatus according to claim 1, wherein the image forming unit is a line-typed inkjet printing head.

10. The image forming apparatus according to claim 1, wherein the aspiration inlet is formed in an upper position with respect to the supporting member.

11. The image forming apparatus according to claim 1, wherein the aspiration inlet is formed on a same plane as the supporting member.

12. The image forming apparatus according to claim 1, wherein the aspiration inlet is formed in a lower position with respect to the supporting member.

13. The image forming apparatus according to claim 1, wherein the supporting member includes a plurality of supporting members, which are arranged in line along the conveying direction; and wherein the aspirator inlet is formed in proximity to a downstream end of one of the plurality of supporting member being arranged in a most downstream position along the conveying direction.

14. An aspirator device for an image forming apparatus having a conveyer configured to convey a recording medium along a conveying path in a conveying direction, an image forming unit configured to form an image on the recording medium being conveyed, a supporting member arranged in a position to face the image forming unit and configured to support the recording medium, and a sensor configured to detect the recording medium conveyed by the conveyer, the aspirator device comprising:

an aspirator configured to aspirate dust through an aspiration inlet, which is formed in a downstream position along the conveying direction with respect to the image forming unit and in proximity to a downstream end of the supporting member; and an aspiration controller configured to:

control the aspirator to never generate an aspiration force at the aspiration inlet while the recording medium faces the aspiration inlet and until a rear end of the recording medium passes by the aspiration inlet along the conveying direction, based on a detected result by the sensor; and control the aspirator to start generating the aspiration force at the aspiration inlet within a predetermined time period after the rear end of the recording medium passes by the aspiration inlet along the conveying direction.

15. The image forming apparatus according to claim 1, wherein the sensor is arranged in an upstream position with respect to the image forming unit and is configured to detect a front end of the recording medium being conveyed.

16. The image forming apparatus according to claim 15, wherein the aspiration controller determines a time at which the rear end of the recording medium will pass by the aspiration inlet based on a time at which the sensor detects the presence of the front end of the recording medium.

17. The image forming apparatus according to claim 1, wherein the aspiration controller is configured to determine that the recording medium faces the aspiration inlet from a time at which the sensor detects the presence of a front end of the recording medium in the conveying direction until a time at which the sensor detects the presence of a rear end of the recording medium in the conveying direction.

18. The image forming apparatus according to claim 1, wherein the aspiration controller is configured to determine that the recording medium faces the aspiration inlet from a time after which the sensor detects the presence of a front end of the recording medium in the conveying direction until a time after which the conveyor has rotated by a particular amount.

19. The image forming apparatus according to claim 1, wherein the aspiration controller is configured to determine that the recording medium faces the aspiration inlet from a time after which the sensor detects the presence of a front end of the recording medium in the conveying direction until a particular period of time has passed.

* * * * *